US005612500A

United States Patent [19]

Liang

[11] Patent Number: 5,612,500

[45] Date of Patent: Mar. 18, 1997

[54] MUSIC BELL

[76] Inventor: Fu-Chern Liang, 58, Ma Yuan West St., Taichung, Taiwan

[21] Appl. No.: 565,190

[22] Filed: Nov. 6, 1995

[51] Int. Cl.[6] ..... G10D 13/08

[52] U.S. Cl. ..... 84/402; 84/404; 116/141; D17/22; 446/418; D10/119

[58] Field of Search ..... 84/402, 404; 116/141, 116/169; D17/22, 99; 446/418; D10/116, 119; 428/11

[56] References Cited

U.S. PATENT DOCUMENTS 1,012,560 12/1911 Keller ..... 116/169

5,107,796 4/1992 Embrey ..... 428/11

*Primary Examiner*—Cassandra C. Spyrou

[57] ABSTRACT

A music bell has a dangling member surrounded by a plurality of bell plates. The upper end of the dangling member links an annular chain, and the lower end of the dangling member connects a bob vane. All the bell plates have various thickness. The upper ends of the bell plates and the upper end of the dangling member are connected together. A striking device is disposed in the middle of the dangling member.

15 Claims, 9 Drawing Sheets

MUSIC BELL

BACKGROUND OF THE INVENTION

The invention relates to a music bell. More particularly, the invention relates to a music bell with various thickness of bell plates.

Referring to FIG. 8, a conventional music bell of a music box has a rotating handle 11 to wind a clockwork spring 15. The spring 15 will be unwound gradually and automatically to rotate a bearing cylinder 13. The protrusions 14 on the outer surface of the bearing cylinder 13 will touch the corresponding elastic plates 12 in order to vibrate the elastic plates 12. The vibration of the elastic plates 12 produces music sounds while the bearing cylinder 13 is rotating. However, the unwound period of time is very short. The user must always wind the spring 15 in order to hear the music sounds frequently. After a long period of usage, the spring 15 will become elastic fatigue. The user may break the conventional music bell by unwinding the spring 15 fast in the wrong direction.

SUMMARY OF THE INVENTION

An object of the invention is to provide a music bell which can produce music sounds while the music bell is shaked by the wind or the user.

Another object of the invention is to provide a music bell which has a plurality of bell plates with various thickness in order to produce sounds with different music tones of compass.

In accordance with the invention, a music bell has a dangling chain surrounded by a plurality of bell plates. The upper end of the dangling chain links an annular chain, and the lower end of the dangling chain connects a bob vane. All the bell plates have various thickness. The upper ends of the bell plates and the upper end of the dangling chain are welded together. A striking device is disposed in the middle of the dangling chain.

In addition, the invention provides another music bell which has a dangling member surrounded by a plurality of bell plates. An upper connector connects an upper end of the dangling member and a bent upper portion of each bell plate. An upper portion of the upper connector links an annular chain. A lower end of the dangling member connects a bob vane. Each bell plate has various thickness. A striking device is disposed in a middle of the dangling member.

DETAILED DESCRIPTION OF THE INVENTION

Figure 1:
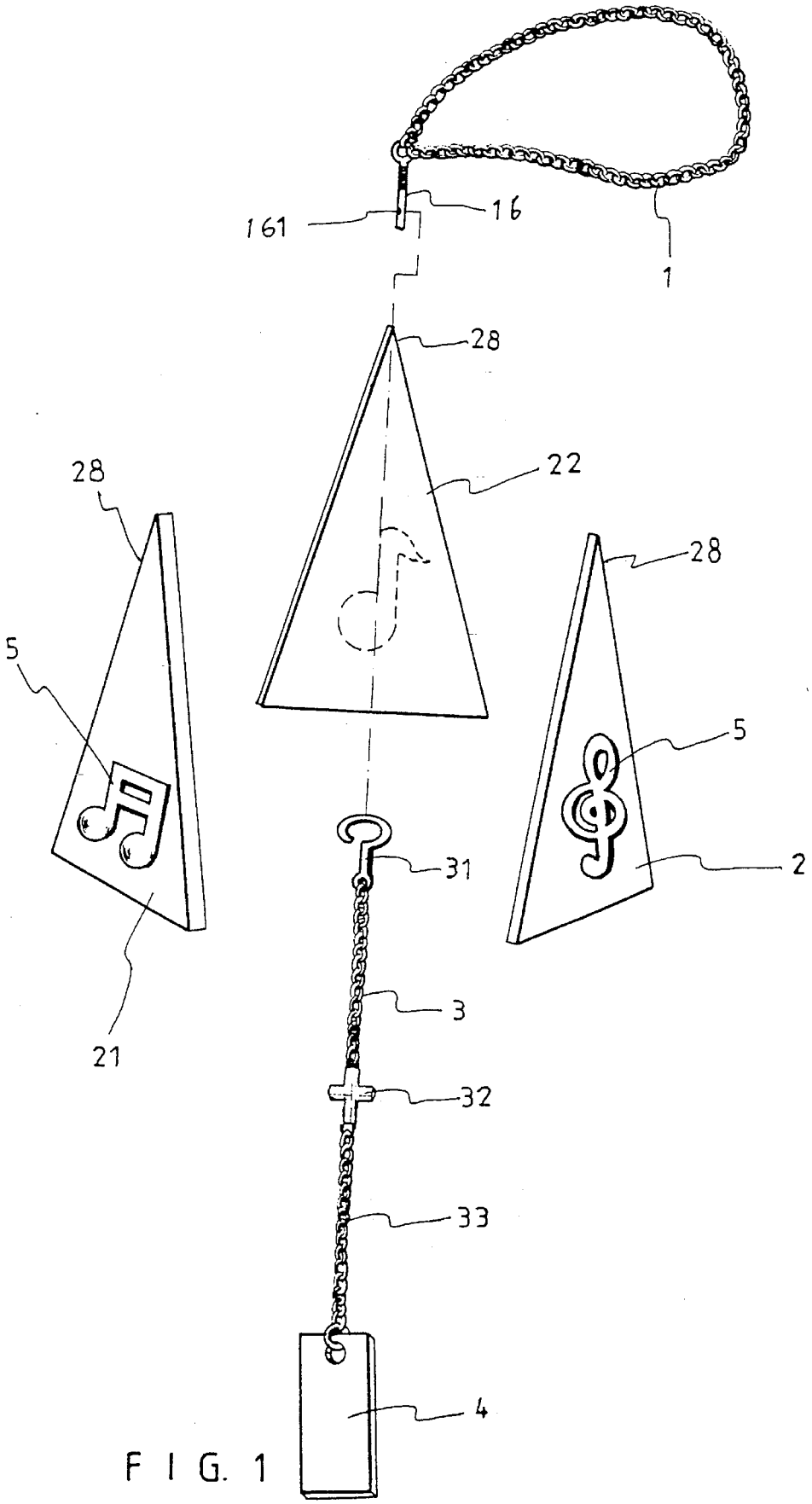
FIG. 1 is a perspective exploded view of a music bell of a preferred embodiment in accordance with the invention.
Figure 2:
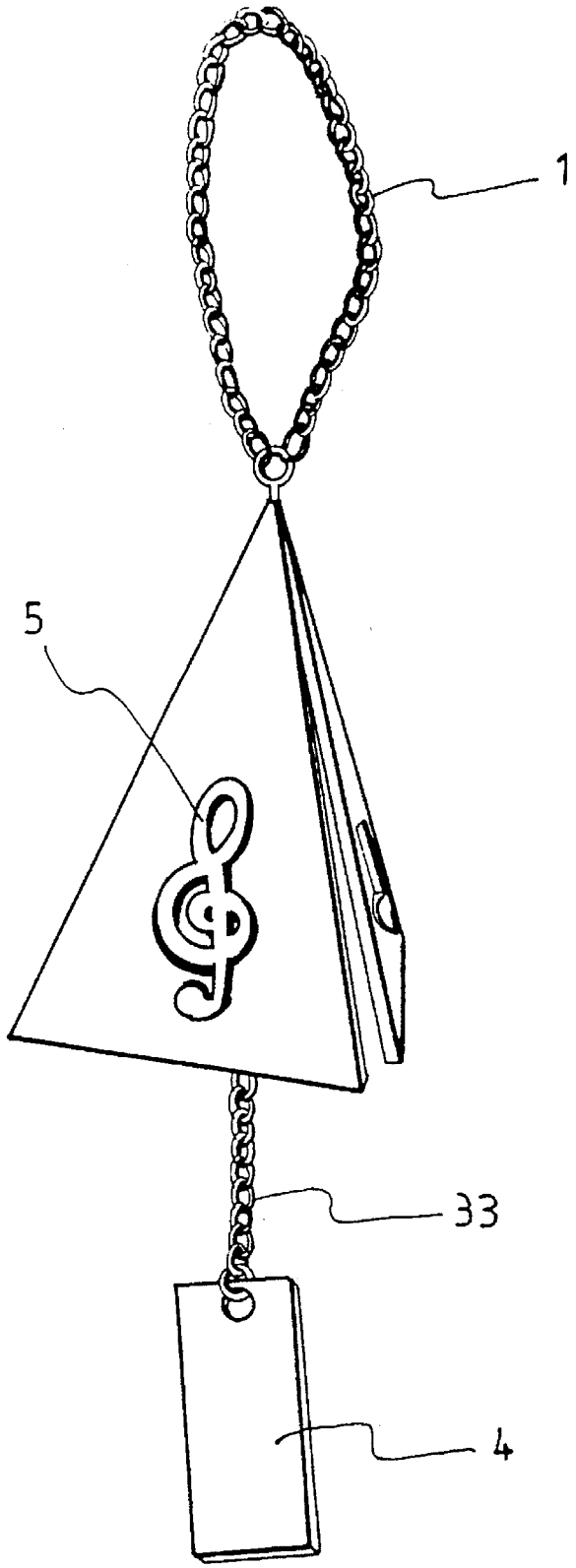
FIG. 2 is a perspective assembly view of FIG. 1.

Referring to FIGS. 1 and 2, a music bell has the first, the second and the third bell plates 2, 21 and 22 with various thickness according to different music tones of compass. For example, the first bell plate 2 has the smallest thickness and the third bell plate 22 has the largest thickness. A dangling chain which has an upper chain 3, a lower chain 33, a cross 32 disposed between the upper chain 3 and the lower chain 33 as a striking device, a hook 31 on the upper end of the upper chain 3 and a bob vane 4 on the lower end of the lower chain 33 is surrounded by three bell plates 2, 21 and 22. The hook 31 inserts a circular hole 161 of a post 16 which links an annular chain 1. All the bell plates 2, 21 and 22 have various thickness. The post 16 and the upper ends 28 of the bell plates 2, 21 and 22 are welded together. Each bell plate 2, 21 or 22 has an ornament 5 on the outer surface of the bell plate 2, 21 or 22.

Figure 2A:
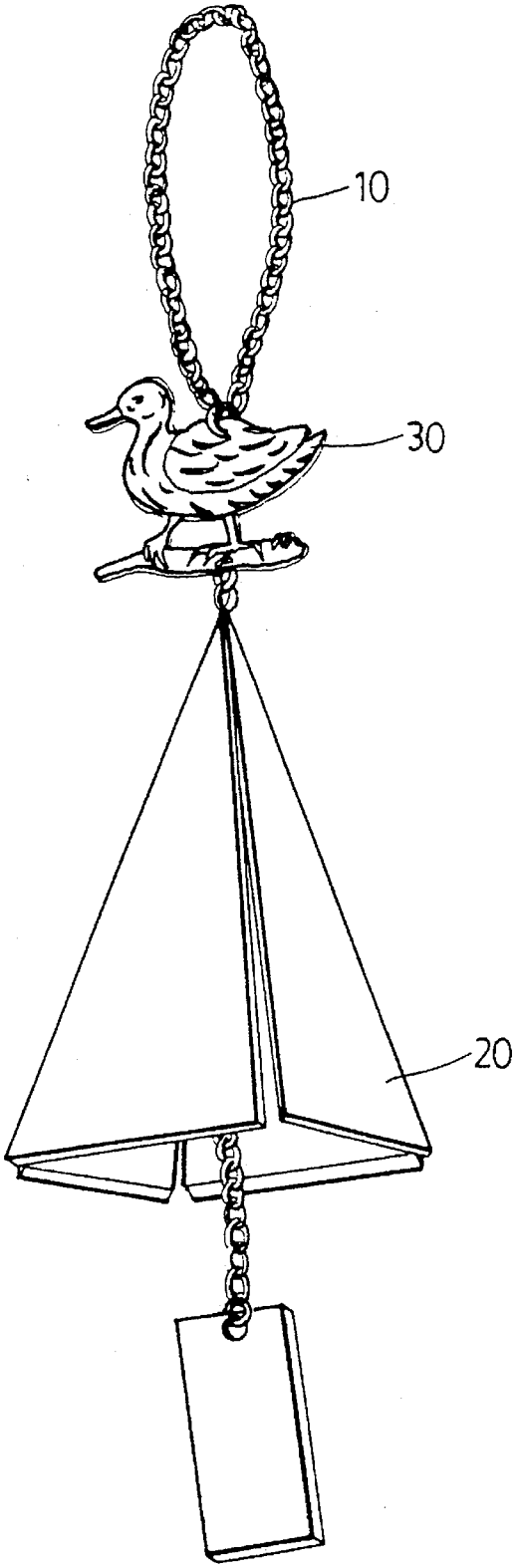
FIG. 2A is a perspective assembly view of a music bell of a preferred embodiment with a decoration thereon.

Referring to FIG. 2A, a decorated duck 30 is disposed beneath the annular chain 10. The upper ends of four plates 20 are welded together.

Figure 3:
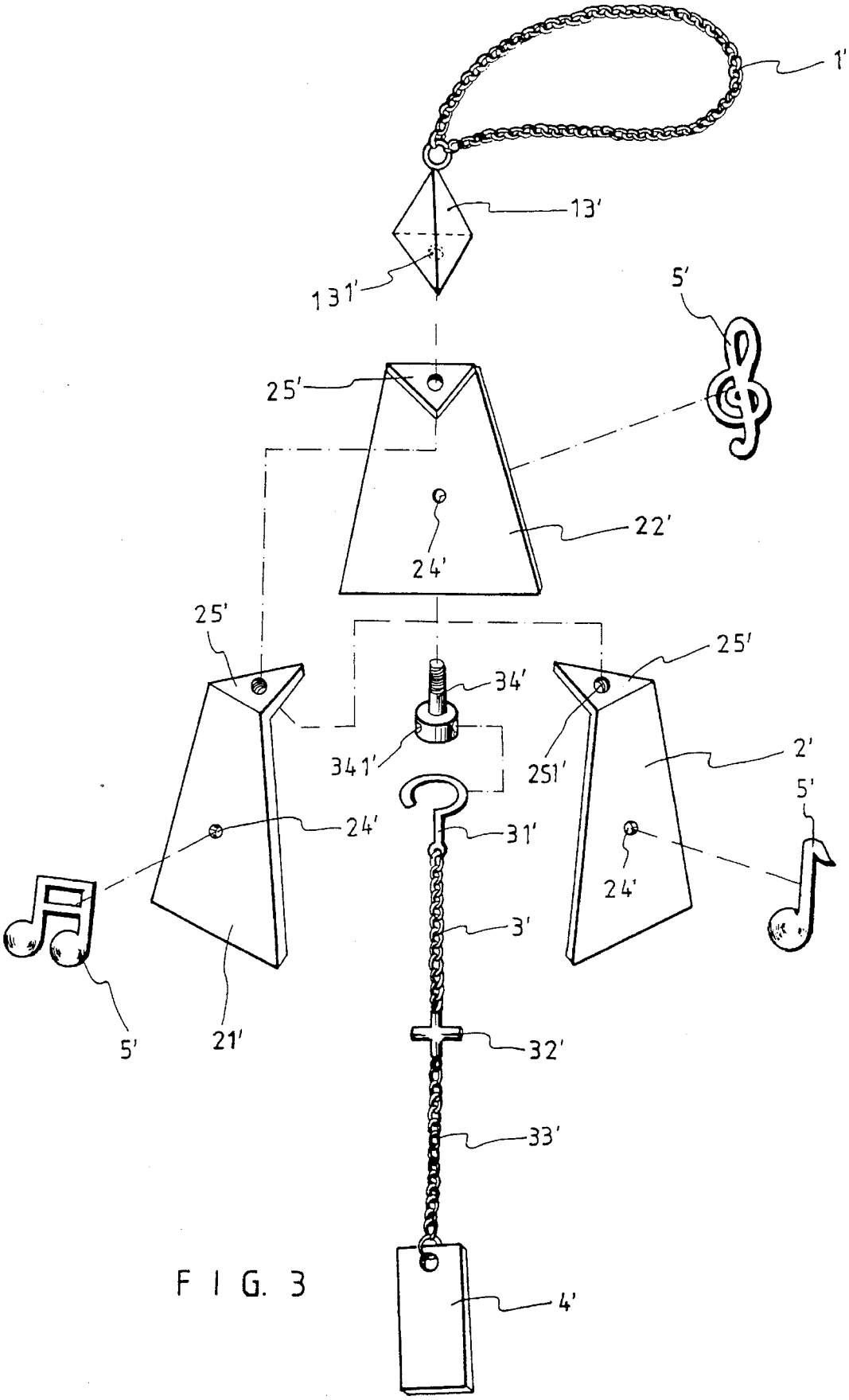
FIG. 3 is a perspective exploded view of a music bell of a preferred embodiment in accordance with the invention.
Figure 4:
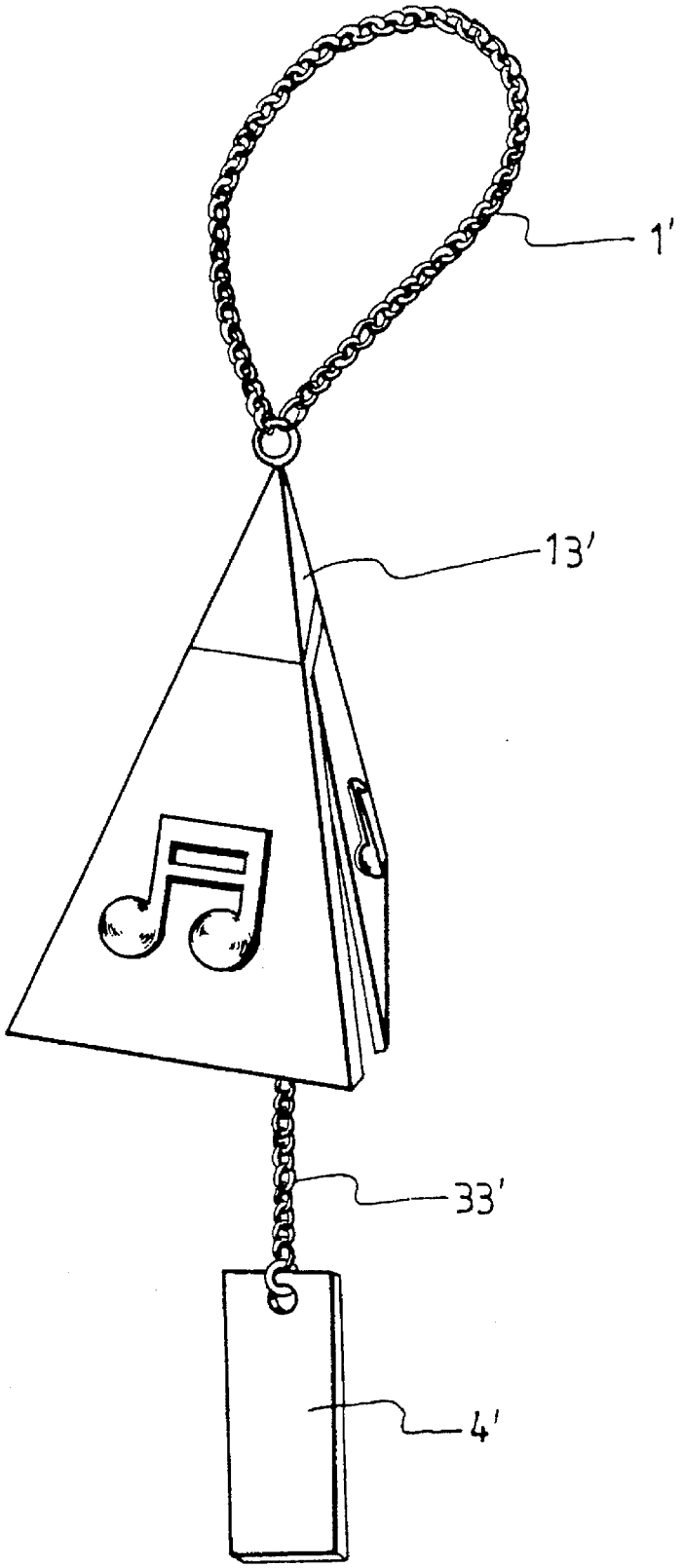
FIG. 4 is a perspective assembly view of FIG. 3.

Referring to FIGS. 3 and 4, a music bell has the first, the second and the third bell plates 2', 21' and 22' with various thickness. Each bell plate 2', 21' or 22' has a circular hole 24' to receive a rear portion of an ornament 5' and a bent upper portion 25'. The bent upper portion 25' has a round hole 251' to be fastened by a threaded fastener 34'. A pyramid 13' which links an annular chain 1' has a bottom hole 131' to receive the threaded fastener 34'. The threaded fastener 34' has a circular hole 341' to receive a hook 31'. The hook 31' connects the upper end of an upper chain 3'. The upper chain 3' and the lower chain 33' are connected with a cross 32' which is used as a striking device. A bob vane 4' is disposed at the lower end of the lower chain 33'.

Figure 5:
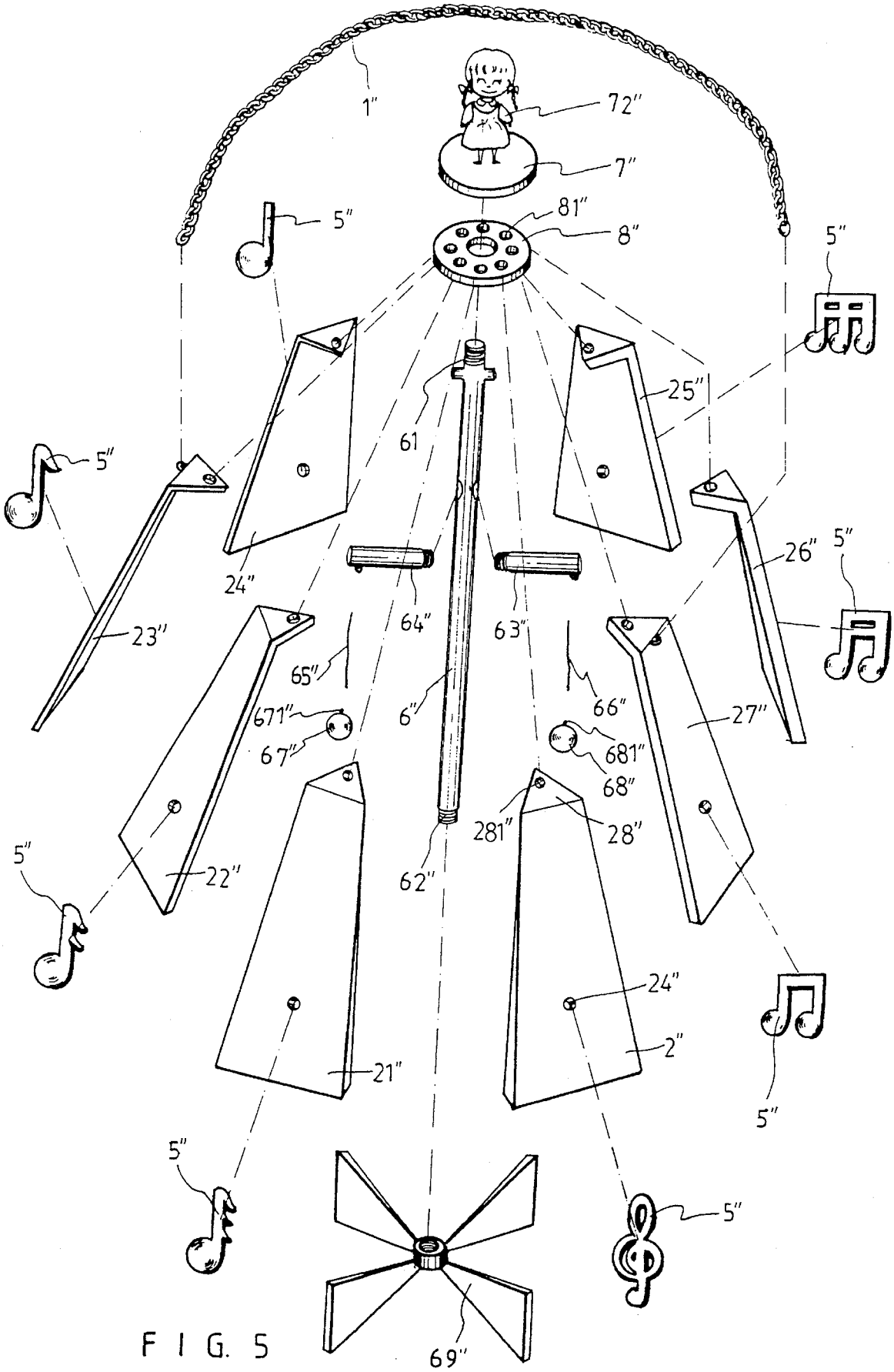
FIG. 5 is a perspective exploded view of a music bell of the third preferred embodiment in accordance with the invention.
Figure 6:
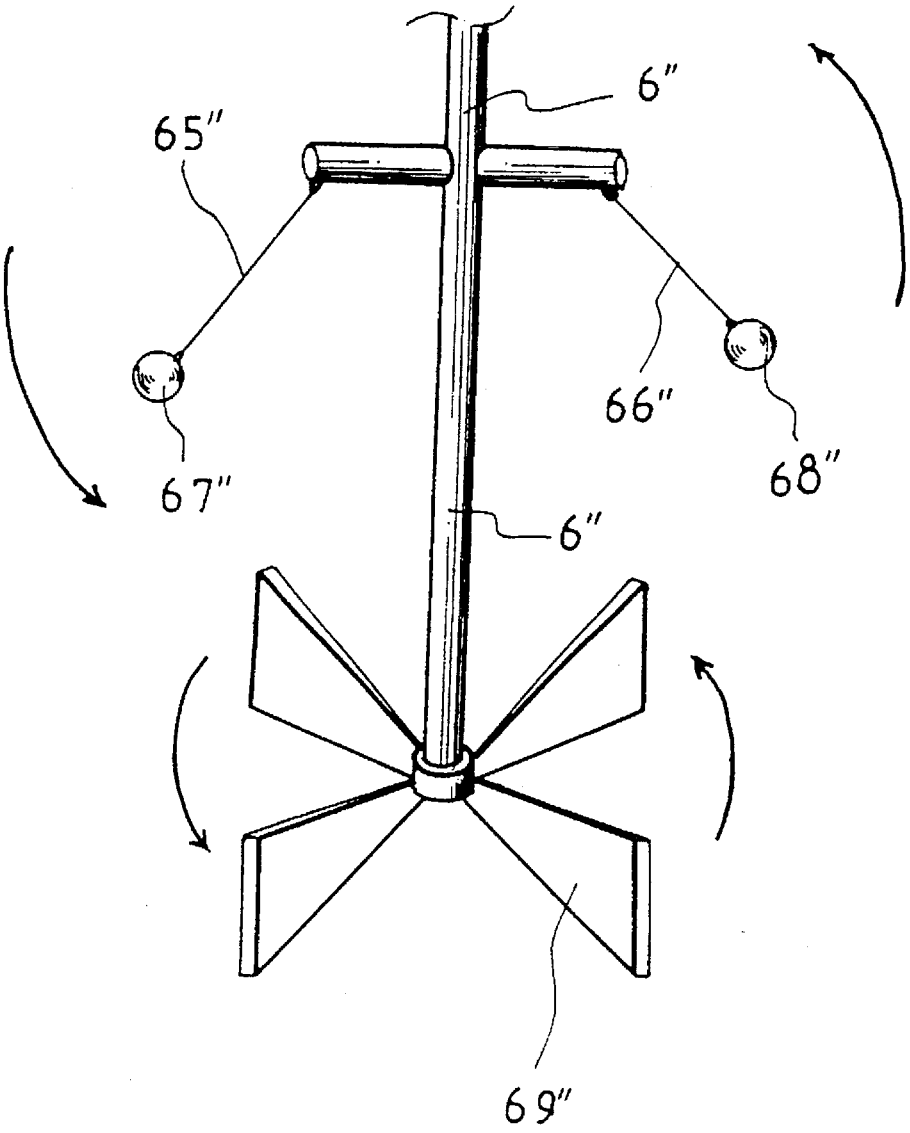
FIG. 6 is a partly schematic view illustrating the operation of the music bell of the third preferred embodiment.
Figure 7:
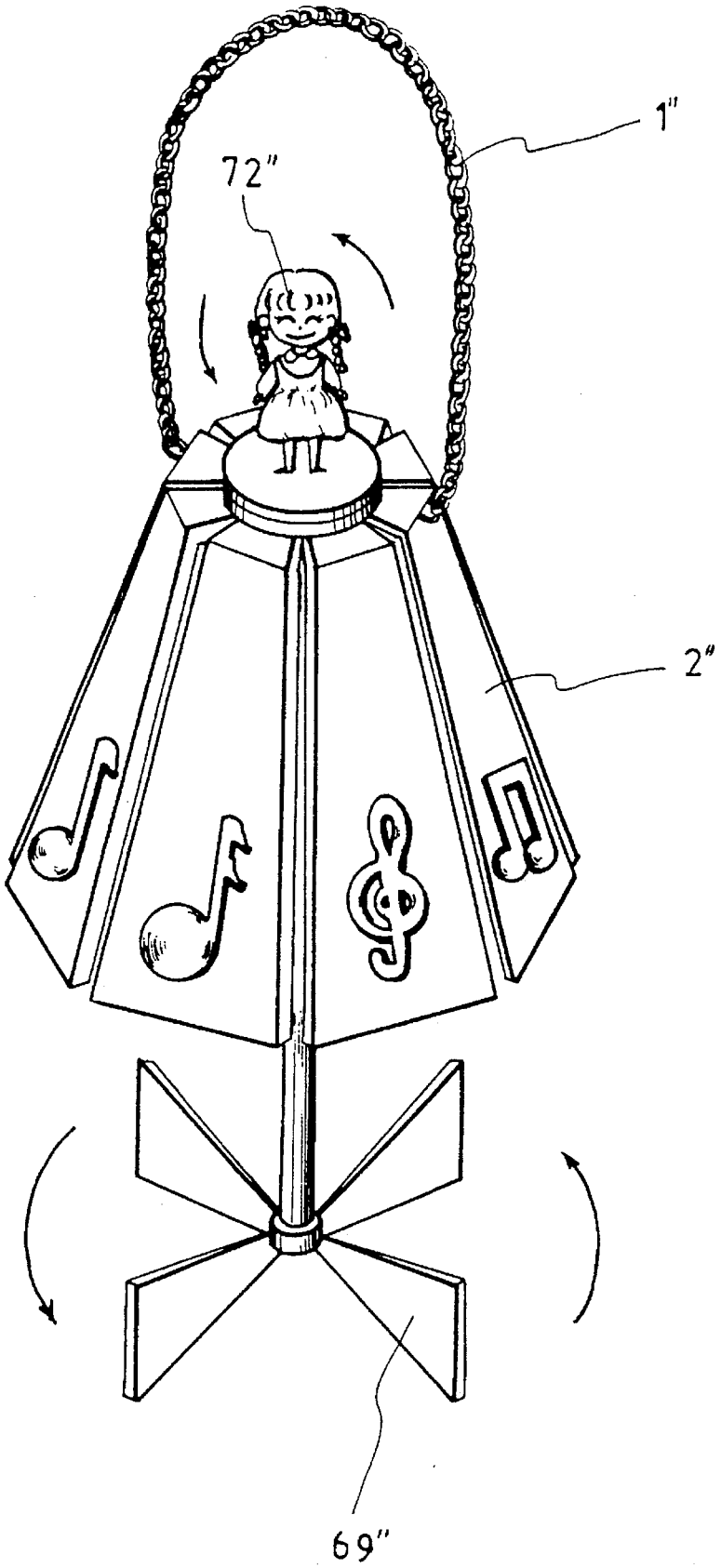
FIG. 7 is a perspective assembly view of FIG. 5 illustrating the operation of the music bell of the third preferred embodiment.
Figure 8:
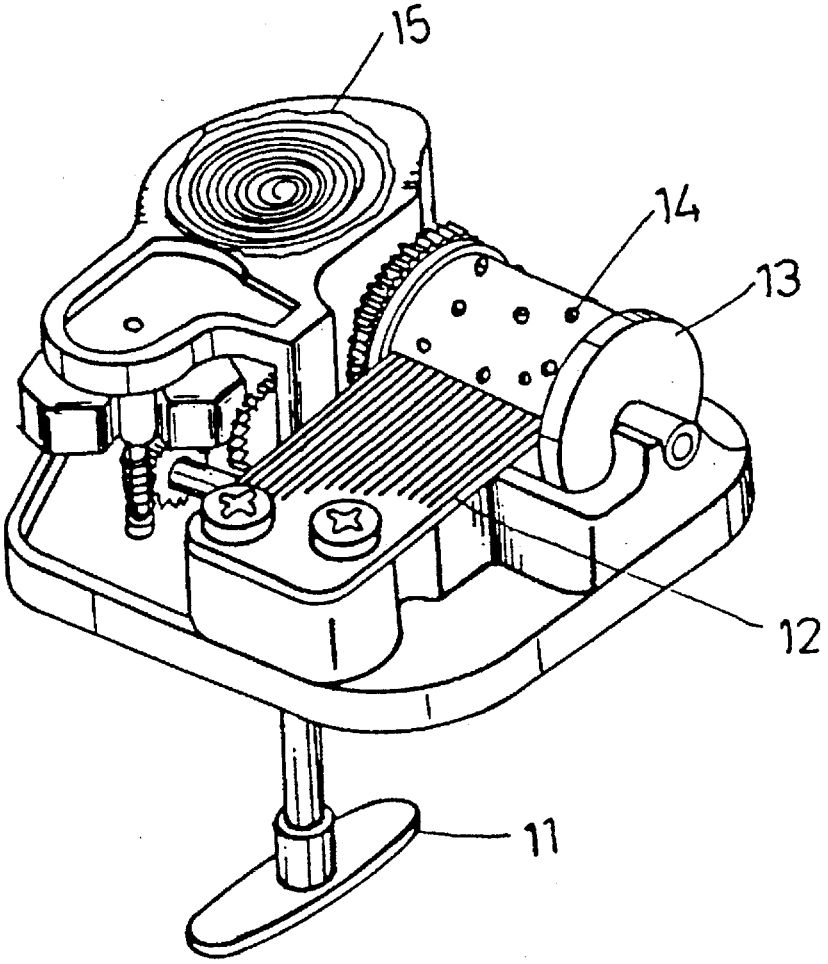
F I G. 8 PRIOR ART
FIG. 8 is a perspective assembly view of a music bell of the prior art.

Referring to FIGS. 5 to 7, a music bell has the first, the second, the third, the fourth, the fifth, the sixth, the seventh and the eighth bell plates 2", 21", 22", 23", 24", 25", 26" and 27" with various thickness. Each bell plate 2", 21", 22", 23", 24", 25", 26" or 27" has a circular hole 24" to receive a rear portion of an ornament 5" and a bent upper portion 28". The bent upper portion 28" has a round hole 281". An upper disk 7" matches a corresponding lower disk 8" which has a center hole and a plurality of periphery holes 81". The upper end 61" of a dangling rod 6" inserts through the center hole of the lower disk 8". The periphery holes 81" match the corresponding round holes 281", respectively, so that they are fastened by a fastening member. The lower end 62" of the dangling rod 6" connects a bob vane 69". Two transverse bars 63" and 64" are disposed on the dangling rod 6". Each bar 63" or 64" has a thread 66" or 65" to fasten a lobe 671" or 681" of a ball 67" or 68". A decoration 72" is disposed on the upper disk 7". An annular chain 1" connects two bell plates 23" and 27". FIGS. 6 and 7 illustrate the operation of the music bell.

The invention is not limited to the above embodiments but various modification thereof may be made. It will be understood by those skilled in the art that various changes in form and detail may be made without departing from the scope of the invention.

I claim:

1. A music bell comprising:

a dangling chain surrounded by a plurality of bell plates;

an upper end of said dangling chain linking an annular chain;

a lower end of said dangling chain connecting a bob vane;

each of said bell plates having various thickness;

an upper end of each of said bell plates and an upper end of said dangling chain welded together; and a striking device disposed in a middle of said dangling chain.

2. A music bell as claimed in claim 1, wherein said striking device divides said dangling chain into an upper chain and a lower chain.

3. A music bell as claimed in claim 1, wherein said striking device is a cross.

4. A music bell as claimed in claim 1 or 2, wherein each of said bell plates has an ornament thereon.

5. A music bell comprising:

a dangling member surrounded by a plurality of bell plates;

an upper connector connecting an upper end of said dangling member and a bent upper portion of each of said bell plates;

an upper portion of said upper connector linking an annular chain;

a lower end of said dangling member connecting a bob vane;

each of said bell plates having various thickness; and a striking device disposed in a middle of said dangling member.

6. A music bell as claimed in claim 5, wherein a decoration is disposed on top of said upper connector.

7. A music bell as claimed in claim 5, wherein said upper connector is a pyramid with a bottom hole.

8. A music bell as claimed in claim 5, wherein said upper connector contains an upper disk and a corresponding lower disk.

9. A music bell as claimed in claim 8, wherein said lower disk has a center hole and a plurality of periphery holes.

10. A music bell as claimed in claim 5, wherein said dangling member is a dangling rod.

11. A music bell as claimed in claim 5, wherein said dangling member is a dangling chain.

12. A music bell as claimed in claim 11, wherein said striking device divides said dangling chain into an upper chain and a lower chain.

13. A music bell as claimed in claim 5, wherein said striking device has two balls.

14. A music bell as claimed in claim 5, wherein said striking device is a cross.

15. A music bell as claimed in claim 7 or 8, wherein each of said bell plates has an ornament thereon.

* * * * *